US005373609A

United States Patent [19]

Ferrari et al.

[11] Patent Number: 5,373,609

[45] Date of Patent: Dec. 20, 1994

[54] FOUR-BAR LINKAGE HINGE WITH IMPROVED OPENING MECHANISM

[75] Inventors: Franco Ferrari, Frazione Deviscio 2, 22053 Lecco, Italy; Carlo Migli, Lecco, Italy

[73] Assignee: Franco Ferrari, Lecco, Italy

[21] Appl. No.: 94,885

[22] Filed: Jul. 22, 1993

[30] Foreign Application Priority Data

Aug. 7, 1992 [IT] Italy ..... MI92 U 000779

[51] Int. Cl.[5] ..... E05D 15/32

[52] U.S. Cl. ..... 16/370; 16/288

[58] Field of Search ..... 16/370, 288, 291, 293, 16/366

[56] References Cited

U.S. PATENT DOCUMENTS 3,744,086 7/1973 Salice et al. ..... 16/296

4,226,001 10/1980 Salice ..... 16/296

FOREIGN PATENT DOCUMENTS 2408057 8/1975 Germany ..... 16/294

3840245 5/1990 Germany ..... 16/370

*Primary Examiner*—P. Austin Bradley

*Assistant Examiner*—Chuck Y. Mah

*Attorney, Agent, or Firm*—Shlesinger Fitzsimmons Shlesinger

[57] ABSTRACT

A four-bar linkage hinge comprises two fastening elements (11, 12) with a first (14) and a second link (13) pivoted by their ends, respectively, to each fastening element (11, 12). The first link (14) has an extension (20) which rests on a free arm (25) of a spring (21) which reacts with its other end (24) on one of the two fastening elements, and which exerts pressure on said extension (20) in order to rotate the link to shift the hinge from a nearly closed to a closed position. The arm (25) bears a cam surface with a raised area (28) which is traversed by said extension (20) when the hinge is in the nearly open position, to permit the release of the spring (21) on continuation of the opening movement and push the hinge open.

5 Claims, 1 Drawing Sheet

FOUR-BAR LINKAGE HINGE WITH IMPROVED OPENING MECHANISM

In the known four-bar linkage hinges, the mechanism is made in such as way as to achieve a bias which enables the door to be held in a firmly closed position. This mechanism is usually achieved by means of a spring, for example, a flat or wire spring, which acts on a cam surface on the lower link of the hinge so that the door has a satisfactory bias in closing whereas it is practically free beyond a pre-established angle of aperture, generally in the region of 45°.

In some applications, however, this tendency is not desirable. For example, many applications in the furniture industry, especially in the kitchen and bedroom furniture sector, make use of drawers fitted into furniture cabinets provided with normal hinged doors. In these applications, the door must open at least 90° to allow the drawer to be pulled out properly, without it bumping against the inside of the door. Since the known four-bar linkage hinges only have a bias action in closing, it can happen that the door opens only partially or tends to close while a drawer is being pulled out, thereby preventing it from being pulled out completely and scratching the internal surface of the door.

In order to partially remedy this problem, furniture units have even been proposed in which the outermost ends of the drawers are provided with wheels on a vertical axle, so that by moving the drawer with the door not completely open, the wheel runs along the door, and pushes it open completely without damaging the surface excessively. This solution is obviously a mere palliative even though it involves quite a considerable cost. Moreover, the problem of incomplete opening of the door is attenuated only in the specific case of drawer units, while it arises every time a cumbersome object has to be pulled out of furniture fitted with doors.

Unfortunately, the limited space inside four-bar linkage hinges is practically already taken up by the spring-operated closing mechanism and it is not possible to add further kinematic opening mechanisms without considerably increasing their size, complexity and cost.

The general scope of this invention is to obviate the aforementioned problems, by providing a four-bar linkage hinge which, although being of the same size, complexity and cost as the known hinges, has a bias action in opening which enables it to reach and remain in a pre-established open position, for example, wider than 90°.

This scope is achieved according to the invention by providing a four-bar linkage hinge comprising two fastening elements with a first and a second link pivoted by their ends, respectively, to each fastening element, the first link having an extension which rests on a free arm of a spring which reacts with its other end on one of the two fastening elements, and which exerts pressure on said extension in order to rotate the link to shift the hinge from a nearly closed to a closed position, characterized by the fact that said arm bears a cam surface with a raised area which is traversed by said extension when the hinge is in the nearly open position, to permit the release of the spring on continuation of the opening movement and push the hinge open.

The innovatory principles of this invention and its advantages compared to the known technique will be more clearly evident from the following description of a possible exemplificative and non restrictive embodiment applying such principles, with reference to the accompanying drawings, in which.

Figure 1:
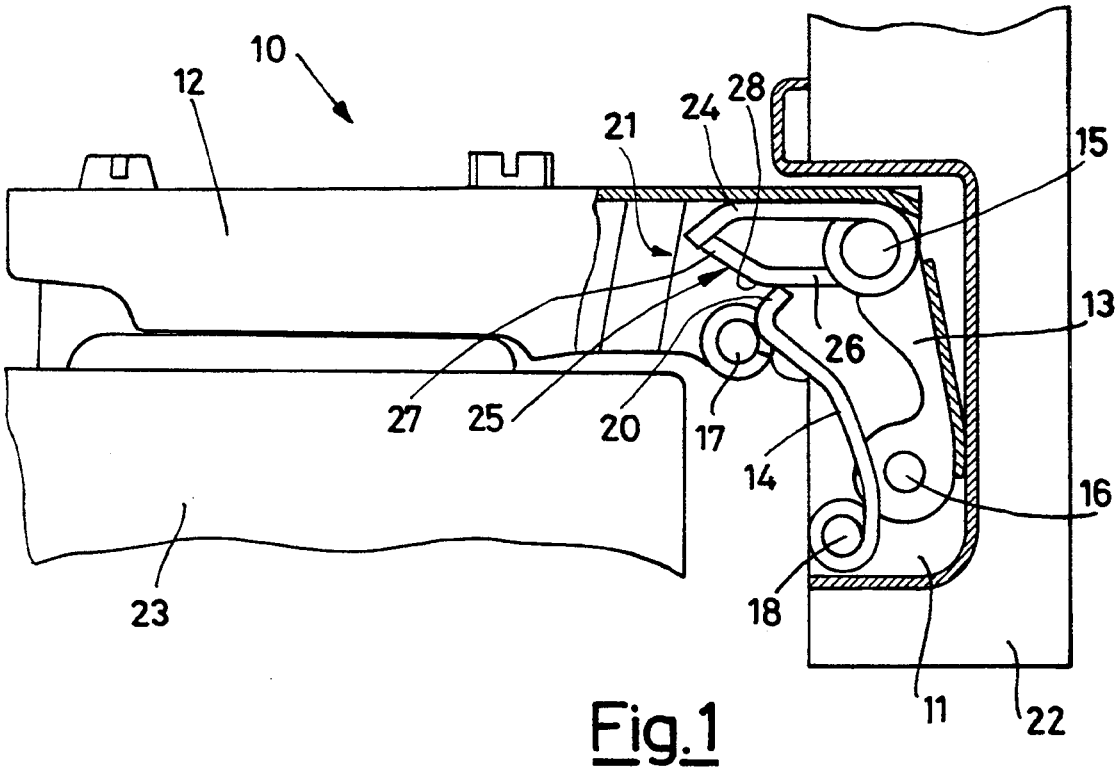
FIG. 1 shows a cross-sectional view of a hinge, made according to the invention, in the closed position.

With reference to the figures, a hinge 10 comprises two fastening elements 11, 12, for example a known cup-shaped element 11 (to be flush-mounted in a door 22) and a known wing-shaped element 12 (to be secured by known means to a side panel 23 of the furniture cabinet), hinged together by means of a pair of upper and lowers links 13, 14, respectively. The link 13 is pivoted to the wing and cup respectively by pins 15 and 16, while the lower link is pivoted to the wing and cup respectively by pins 17, 18 so as to form a known four-bar linkage hinge. Wound around the pin 15 is a spring 21 with free ends 24, 25 reacting respectively against an internal wall of the wing and against an extension 20 protruding from the lower link 14.

The description so far is of a substantially known hinge. In the known hinges, the thrust spring is made with rectilinear arms and exerts pressure on the extension so that the line of action of the thrust of the spring remains substantially between the pin 17 and the pin 18, thereby providing the link 14 with the above-mentioned bias action in closing, while the movement of the hinge beyond a certain angle of aperture (generally 30°) is left completely free.

On the contrary, according to the principles of this invention, the arm 25, of the spring 21, which exerts pressure on the extension 20 is nor straight or flat, but instead is non-rectilinear and has a cam surface having a raised area 28, in order to define a dead centre at a pre-established angle of aperture of the hinge (for example, 30°) in which the force of action of the spring on the extension 20 passes through the pin 17. In this way, when the spring goes beyond dead centre it reverses its effect by pushing the extension of the link in the opposite direction. Thus, below the angle established for dead centre the door is subjected to increasing thrust towards the closed position, as occurs in the known hinges, while above this angle the door is forced to open with decreasing pressure. The spring can be slanted in the portion close to the free end at such an angle, for example, as to ensure that in the second working area of the spring, beyond dead centre, the thrust necessary to open the door decreases up to 90° and then drops substantially to zero so that the door is once again completely free only beyond an aperture of 90° (taking into account that the link 14 is substantially stationary when the hinge is almost fully open).

The cam surface can be made in various ways, comprising, for example, an appropriate addition of material. It was, however, found to be advantageous to make it simply as a variation in the slant along the length of the arm of the spring.

Although said variation in the slant of the spring can be continuous, it was found advantageous for it to be made in the form of a sharp bend correspondence with the dead centre, and for the portions of the arm before and after the bend to be left rectilinear.

In this way, the arm 25 has a first portion 26, close to the pin 15, with a first rectilinear direction, and a second portion 27, close to the end of the arm, with a second rectilinear direction at an angle compared to the first one.

As can be seen in FIG. 1, when the hinge is moved toward an open position between 0 and, for example, 30°, the extension 20 slides over the first portion 26 of the spring. The line of thrust of the spring will therefore be between the pin 17 and the pin 18 and consequently operates in a substantially similar way to the known hinges to urge link 14 clockwise about the axis of pin 17, thereby to push the door closed. As the door is opened the spring is consequently compressed.

Figure 2:
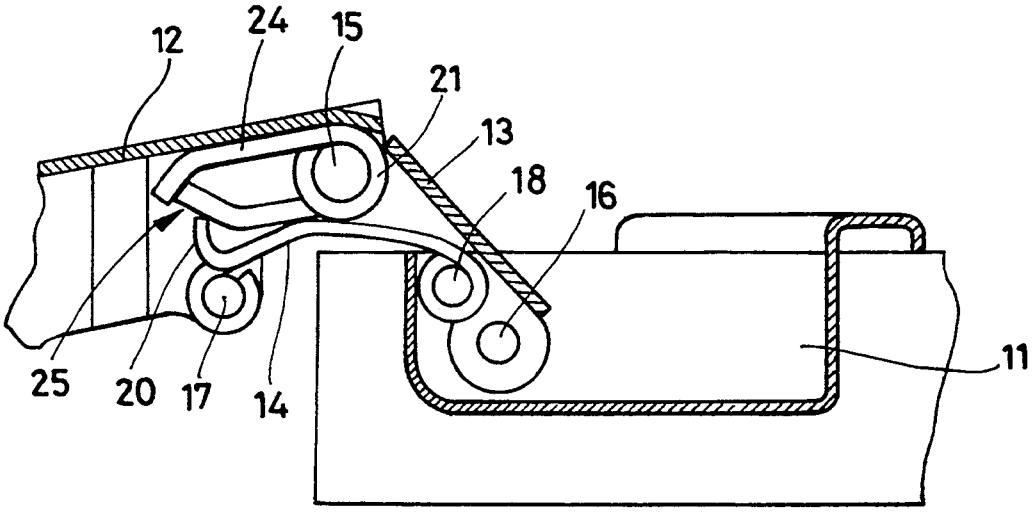
FIG. 2 shows a view of the hinge of FIG. 1 in the open position.

As can be seen in FIG. 2, beyond the pre-established angle of aperture, the extension 20 traverses the raised area 28 and slides along the second portion 27 of the spring. Since said portion is slanted so as to shift it away from the extension, the spring consequently tends to relax or in other words, it shifts the line of thrust of the spring beyond the pin 17 with a considerable arm for effecting an anti-clockwise movement of link 14 about pin 17 as shown in the figure. The spring thus operates in the opening direction.

Since the thrust required to open the door decreases in proportion to the angle of aperture reached (precisely due to the reduced movement of the lower link as it approaches maximum aperture), it prevents the danger of the door being flung violently into the fully open position. In substance, the door moves gently to an open position in the region of 90° even when it is left in an intermediate position.

It will be clear at this point that the intended scopes are reached by providing a hinge which, in addition to the normal closing bias function, presents a gentle opening bias function. This is achieved without increasing the overall dimensions, complexity or cost of the hinge compared to hinges of known technique devoid of the opening bias function.

The foregoing description of an embodiment applying the innovatory principles of this invention is obviously given by way of example in order to illustrate such innovatory principles and should not therefore be understood as a limitation to the sphere of the invention claimed herein. For example, the precise shape of the cup and wing may vary according to need, as can be easily imagined by any expert in the field. As mentioned previously, the cam surface can also be obtained by fitting a suitably-shaped element on the free arm 25 of the spring.

We claim:

1. Four-bar linkage hinge comprising two fastening elements (11, 12) and a first link (14) and a second link (13) each of said links being pivoted at their ends, respectively, to each fastening element (11, 12), the first link (14) having adjacent one end thereof an extension (20), a spring (21) having a first arm (25) engaged with said extension (20), and a second arm (24) engaged with one of the two fastening elements, said spring being operative to exert closing pressure on said extension (20) in order to rotate said first link in a direction to shift the hinge from a nearly closed to a closed position, and characterized by the fact that said first arm (25) has thereon intermediate its ends a cam surface having a raised area (28) which is traversed by said extension (20) upon movement of the hinge to a nearly open position, and which operates upon opening movement of the hinge to permit the release said closing pressure of the spring (21) on continuation of the opening movement of the hinge beyond said nearly open position and thereafter to push the hinge open.

2. Hinge as claimed in claim 1, characterized by the fact that the spring (21) is centrally wound intermediate its arms around a pivot (15) of the second link (13).

3. Hinge as claimed in claim 1, characterized by the fact that the cam surface is obtained by bending said first arm (25) of the spring (21).

4. Hinge as claimed in claim 3, characterized by the fact that the bend comprises an angle (28) in correspondence with said raised area.

5. Hinge as claimed in claim 4, characterized by the fact that said first arm of the spring extends in a substantially straight line on both sides (26, 27) of the angle.

* * * * *